US006650199B2

(12) United States Patent
Dobrovolny

(10) Patent No.: US 6,650,199 B2
(45) Date of Patent: Nov. 18, 2003

(54) RF A/B SWITCH WITH SUBSTANTIAL ISOLATION

(75) Inventor: Pierre Dobrovolny, North Riverside, IL (US)

(73) Assignee: Zenith Electronics Corporation, Lincolnshire, IL (US)

( * ) Notice: Subject to any disclaimer, the term of this patent is extended or adjusted under 35 U.S.C. 154(b) by 53 days.

(21) Appl. No.: 09/977,430

(22) Filed: Oct. 15, 2001

(65) Prior Publication Data

US 2003/0071698 A1 Apr. 17, 2003

(51) Int. Cl.[7] ..... H01D 5/12
(52) U.S. Cl. ..... 333/103; 333/104
(58) Field of Search ..... 333/103, 104, 333/134, 101, 136; 455/266, 132, 82, 83

(56) References Cited

U.S. PATENT DOCUMENTS 5,170,139 A * 12/1992 Nelson ..... 333/103
5,475,875 A * 12/1995 Katsuyama et al. ..... 455/275
5,519,364 A * 5/1996 Kato et al. ..... 333/103
6,014,066 A * 1/2000 Harberts et al. ..... 333/104
6,035,185 A * 3/2000 Dobrovolny et al. ..... 455/266
6,496,083 B1 * 12/2002 Kushitani et al. ..... 333/103

FOREIGN PATENT DOCUMENTS

EP 0928038 A1 * 7/1999 ..... H01P/1/15

* cited by examiner

*Primary Examiner*—Robert Pascal
*Assistant Examiner*—Dean Takaoka

(57) ABSTRACT

An RF A/B switch associated with a receiver has first and second inputs and an output. A first diode circuit includes a plurality of diodes and an impedance network coupled between the first input and the output. A second diode circuit includes a plurality of diodes and an impedance network coupled between the second input and the output. A controller establishes a common series biasing current through at least one of the diodes in each of the first and second diode circuits. The common series biasing current biases one of the first and second diode circuits so as to configure a respective one of the impedance networks in a low pass filter configuration that couples a signal on one of the first and second inputs to the output, and the common series biasing current biases the other of the first and second diode circuits in a blocking configuration so as to block a signal on the other of the first and second inputs from the output.

28 Claims, 2 Drawing Sheets

RF A/B SWITCH WITH SUBSTANTIAL ISOLATION

TECHNICAL FIELD OF THE INVENTION

The present invention relates to an RF A/B switch that has high isolation between the non-selected input and the output of the switch.

BACKGROUND OF THE INVENTION

RF A/B switches are typically used to switch an input of an electronic receiver, such as a tape or disk player/recorder or a television, between two or more RF inputs. Such switches may be external of or internal to the receiver. External A/B switches usually comprise a housing having at least A and B inputs and an output that is coupled to an RF input of the receiver. The housing contains a switch, and a lever protruding through the housing is manually operated to move the switch so as to selectively couple one of the RF inputs to the output.

Internal A/B switches perform essentially the same function of switching a receiver between two or more RF inputs. Internal A/B switches are usually electronic in nature and often respond to a remote control in order to select one of a plurality of inputs. For example, in one known television receiver, the remote control may be used to switch the television receiver between two RF sources. These electronic A/B switches are typically complex in order to isolate the non-selected input from the output so that the signal on the non-selected input does not interfere with the signal from the selected input.

The present invention, at least in part, is directed to an electronic A/B switch that is less complex and/or expensive than prior art high performance electronic A/B switches and yet provides substantial isolation for the non-selected input up to UHF frequencies.

SUMMARY OF THE INVENTION

In accordance with one aspect of the present invention, an RF A/B switch associated with a receiver comprises a first input, a second input, an output, a first diode circuit, a second diode circuit, and a controller. The first diode circuit comprises a plurality of diodes and an impedance network coupled between the first input and the output. The second diode circuit comprises a plurality of diodes and an impedance network coupled between the second input and the output. The controller establishes a common series biasing current through at least one of the diodes in each of the first and second diode circuits. The common series biasing current biases one of the first and second diode circuits so as to configure a respective one of the impedance networks in a low pass filter configuration that couples a signal on one of the first and second inputs to the output, and the common series biasing current biases the other of the first and second diode circuits in a blocking configuration so as to block a signal on the other of the first and second inputs from the output.

In accordance with another feature of the present invention, the first diode circuit in its blocking configuration includes a first equivalent series impedance, the second diode circuit in its blocking configuration includes a second equivalent series impedance, and the RF A/B switch further comprises a first compensation impedance arranged to substantially cancel the first equivalent series impedance at a first predetermined frequency and a second compensation impedance arranged to substantially cancel the second equivalent series impedance at a second predetermined frequency.

BRIEF DESCRIPTION OF THE DRAWINGS

These and other features and advantages of the present invention will become more apparent from a detailed consideration of the invention when taken in conjunction with the drawings in which.

DETAILED DESCRIPTION

Figure 1:
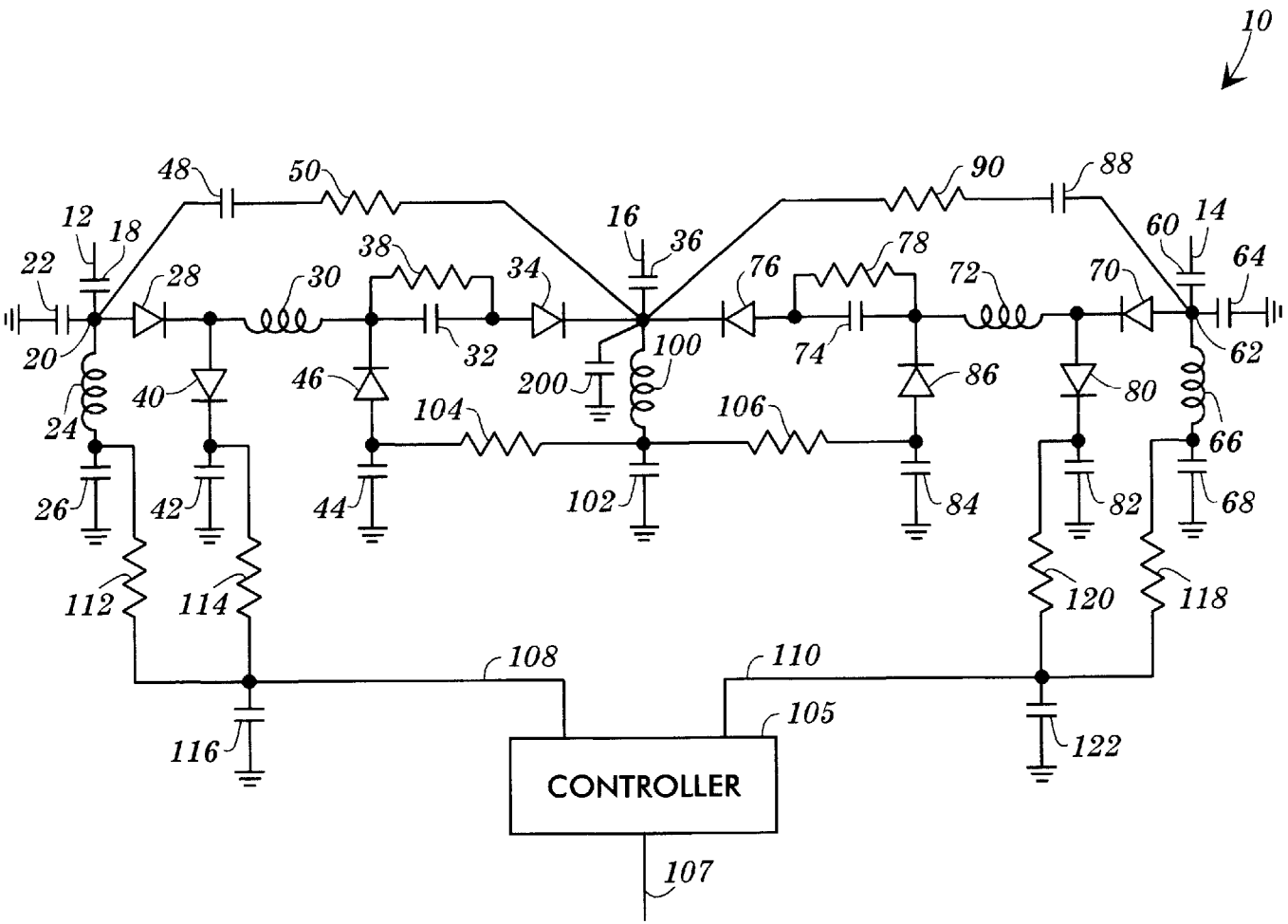
FIG. 1 is a diagram illustrating an embodiment of an A/B switch in accordance with the present invention.

As shown in FIG. 1, an A/B switch 10 includes an A input 12, a B input 14, and an output 16. As will be understood from the description below, the A and B sides of the A/B switch 10 are identical.

A Side Description—The A input 12 is coupled through a capacitor 18 to a node 20. The node 20 is coupled to a reference potential such as ground through a small discrete capacitor 22 or through stray capacitance or through a combination thereof and through a series combination of a choke 24 and an RF bypass capacitor 26. The node 20 is further coupled through a series combination of a diode 28, an inductor 30, an RF bypass capacitor 32, a diode 34, and a capacitor 36 to the output 16. A resistor 38 is coupled in parallel to the RF bypass capacitor 32, and a junction between the diode 28 and the inductor 30 is coupled to the reference potential through a series combination of a diode 40 and an RF bypass capacitor 42. A series combination of an RF bypass capacitor 44 and a diode 46 is coupled from the reference potential to the junction between the inductor 30 and the RF bypass capacitor 32. The node 20 is coupled to the junction between the diode 34 and the capacitor 36 by a series combination of a capacitor 48 and a resistor 50. The capacitance of the capacitor 48 may be a very small value (femtofarads).

B Side Description—Similarly, the B input 14 is coupled through a capacitor 60 to a node 62. The node 62 is coupled to the reference potential through a capacitor 64 (having a small capacitance) and through a series combination of a choke 66 and an RF bypass capacitor 68. The node 62 is further coupled through a series combination of a diode 70, an inductor 72, an RF bypass capacitor 74, a diode 76, and the capacitor 36 to the output 16. A resistor 78 is coupled in parallel to the RF bypass capacitor 74, and a junction between the diode 70 and the inductor 72 is coupled to the reference potential through a series combination of a diode 80 and an RF bypass capacitor 82. A series combination of an RF bypass capacitor 84 and a diode 86 is coupled from the reference potential to the junction between the inductor 72 and the RF bypass capacitor 74. The node 62 is coupled to the junction between the diode 76 and the capacitor 36 by a series combination of a capacitor 88 and a resistor 90. The capacitance of the capacitor 88 may be a very small value (femtofarads).

The junction formed by the diodes 34 and 76 and the capacitor 36 is coupled to the reference potential through a series combination of a choke 100 and an RF bypass capacitor 102. A resistor 104 couples the junction between the RF bypass capacitor 44 and the diode 46 to the junction between the choke 100 and the RF bypass capacitor 102, and a resistor 106 couples the junction between the RF bypass capacitor 84 and the diode 86 to the junction between the choke 100 and the RF bypass capacitor 102.

A controller 105 has an input 107 and outputs 108 and 110. The output 108 is coupled through a resistor 112 to the junction between the choke 24 and the RF bypass capacitor 26, is coupled through a resistor 114 to the junction between the diode 40 and the RF bypass capacitor 42, and is coupled through an RF bypass capacitor 116 to the reference potential. Likewise, the output 110 is coupled through a resistor 118 to the junction between the choke 66 and the RF bypass capacitor 68, is coupled through a resistor 120 to the junction between the diode 80 and the RF bypass capacitor 82, and is coupled through an RF bypass capacitor 122 to the reference potential.

The resistors 104, 112, and 114 together with the RF bypass capacitor 116 are on the A side of the A/B switch 10, and the resistors 106, 118, and 120 together with the RF bypass capacitor 122 are on the B side of the A/B switch 10. The capacitor 36, the RF bypass capacitor 102, and the choke 100 are common to both the A side and the B side of the A/B switch 10.

The controller 105 controls the outputs 108 and 110 so that, when one of them is high, the other is low. The diodes 28, 34, 40, 46, 70, 76, 80, and 86 respond to the outputs 108 and 110 in order to selectively couple one of the A and B inputs 12 and 14 to the output 16. Accordingly, when the output 108 is high and the output 110 is low, the signal on the A input 12 is coupled to the output 16, and the signal on the B input 14 is isolated from the output 16. On the other hand, when the output 108 is low and the output 110 is high, the signal on the B input 14 is coupled to the output 16, and the signal on the A input 12 is isolated from the output 16.

More specifically, when the output 108 is high and the output 110 is low, the diodes 28 and 34 are forward biased and the diodes 40 and 46 are reversed biased. Accordingly, the signal on the A input 12 is coupled through the diodes 28 and 34 to the output 16, and is blocked from the reference potential by the diodes 40 and 46. On the other hand, when the output 108 is high and the output 110 is low, the diodes 70 and 76 are reversed biased and the diodes 80 and 86 are forward biased. Accordingly, the signal on the B input 14 is blocked from the output 16 by the diodes 70 and 76, and is coupled to the reference potential through the diodes 80 and 86. Thus, the signal on the B input 14 is effectively isolated from the output 16.

Likewise, when the output 108 is low and the output 110 is high, the diodes 70 and 76 are forward biased and the diodes 80 and 86 are reversed biased. Accordingly, the signal on the B input 14 is coupled through the diodes 70 and 76 to the output 16, and is blocked from the reference potential by the diodes 80 and 86. On the other hand, when the output 108 is low and the output 110 is high, the diodes 28 and 34 are reversed biased and the diodes 40 and 46 are forward biased. Accordingly, the signal on the A input 12 is blocked from the output 16 by the diodes 28 and 34, and is coupled to the reference potential through the diodes 40 and 46. Thus, the signal on the A input 12 is effectively isolated from the output 16.

Figure 2:
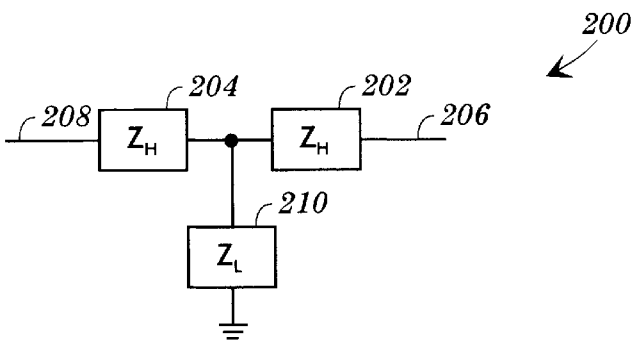
FIG. 2 is an impedance diagram facilitating an explanation of the present invention.

As shown in FIG. 2, the amount of isolation provided by a T network 200 having two series impedance elements 202 and 204 coupling an input 206 to an output 208 and a shunt impedance element 210 coupling the junction between the impedance elements 202 and 204 to ground is dependent upon the impedance values of the impedance elements 202, 204, and 210. Assuming that the impedance elements 202 and 204 have a high impedance $Z_H$ and that the shunt impedance element 210 has a low impedance $Z_L$, the amount of isolation provided by the T network 200 is dependent on the ratio $Z_H/Z_L$. Thus, the isolation can be increased by increasing $Z_H$ and/or by decreasing $Z_L$. However, increasing $Z_H$ is practically limited by the residual capacitance of the reversed biased series diode, and decreasing $Z_L$ is practically limited by the residual resistance and stray inductance of the shunt path.

Figure 3:
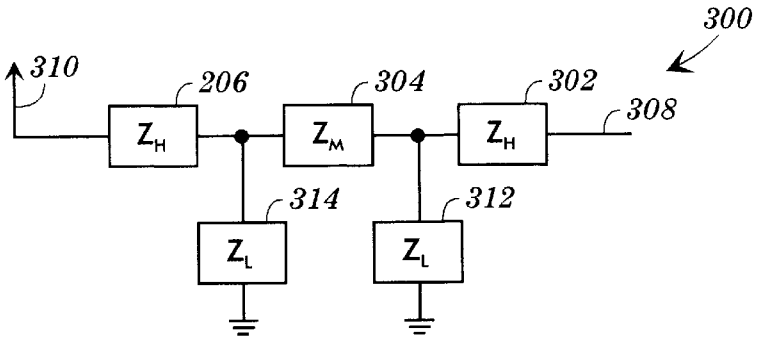
FIG. 3 is a simplified impedance diagram for the B side of the A/B switch when the A side is selected.

As shown in FIG. 3, two T networks may be put together to form a network 300. The network 300 includes three impedance elements 302, 304, and 306 coupling an input 308 to an output 310. An impedance element 312 couples the junction between the impedance elements 302 and 304 to ground, and an impedance element 314 couples the junction between the impedance elements 304 and 306 to ground.

In a general sense, the network 300 is similar to the B side of the A/B switch 10 shown in FIG. 1, where the input 308 corresponds to the B input 14, where the impedance element 302 corresponds to the diode 70, where the impedance element 304 corresponds to the inductor 72, where the impedance element 306 corresponds to the diode 76, where the impedance element 312 corresponds to the diode 80, and where the impedance element 314 corresponds to the diode 86. In a broader sense, these diodes include all of the stray elements associated with any particular layout of the A/B switch 10.

As shown in FIG. 3, when the A side is selected to couple the signal on the A input 12 to the output 16 and the B side is non-selected to isolate the signal on the B input 14 from the output 16, the impedance element 302 has a high impedance $Z_H$, the impedance element 306 also has a high impedance $Z_H$, the impedance element 312 has a low impedance $Z_L$, and the impedance element 314 also has a low impedance $Z_L$. Thus, as explained above in relation to FIGS. 1 and 2, the signal on the input 308 is blocked by the high impedances of the impedance elements 302 and 306 and is instead directed to ground by the low impedances of the impedance elements 312 and 314.

The impedance value of the impedance element 304 representing the inductor 72 is chosen to have a medium value because, if it has a high value, it will attenuate the signal on the B input 14 when the B side is selected to pass the signal on the B input 14 to the output 16 and because, if it has a low value, it will not help to block the signal on the B input 14 when the A side is selected to pass the signal on the A input 12 to the output 16.

The inductor 30 is chosen so that it, with its associated parallel stray capacitances 22 and 200, form a low pass filter, having a cut off above the maximum frequency being switched, when the A side of the A/B switch 10 is selected to pass the signal on the A input 12 to the output 16. Similarly, the inductor 72 is chosen so that it, with its associated parallel stray capacitances 64 and 200, form a low pass filter, having a cut off above the maximum frequency being switched, when the B side of the A/B switch 10 is selected to pass the signal on the B input 14 to the output 16. The values of the resistors, capacitors, and other inductors of the A/B switch 10 are chosen to support the functions described above. In an exemplary embodiment of the invention, each of the inductors 30 and 72 may have a value of 10–20 microhenries.

Figure 4:
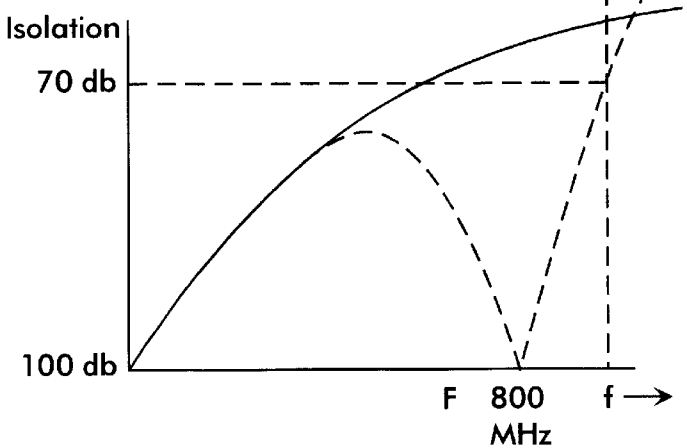
FIG. 4 is a graph showing the improved filtering of the present invention to produce substantial isolation between the inputs of the A/B switch illustrated in FIG. 1.

If the capacitors 48 and 88 and the resistors 50 and 90 are ignored for the moment, the isolation provided by the non-selected side of the A/B switch 10 follows the solid line curve of FIG. 4, wherein the y-axis of this curve is isolation in db and where the x-axis of this curve is frequency. As can be seen, the isolation provided by the non-selected side of the A/B switch 10 decreases from a high value at low frequencies to a lower value at higher frequencies. The addition of the capacitors 48 and 88 and the resistors 50 and 90 improve the isolation by canceling the coupling (i.e., canceling the equivalent series impedance between the input and output of the non-selected side) between their respective sides at a frequency F that is predetermined by the values of these components. The addition of the capacitors 48 and 88 and the resistors 50 and 90 result in a curve that initially follows the solid curve and then deviates to follow the dashed line curve so that isolation is improved at the higher frequencies. Therefore, as shown by way of example in FIG. 4, the isolation stays above 70 db.

The resistive, capacitive, and inductive elements on the B side of the A/B switch 10 may have identical values as on the A side.

Figure 6:
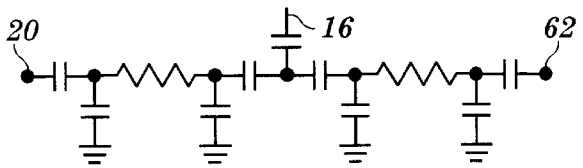

The capacitors 48 and 88 and the resistors 50 and 90 provide generally a very high compensating impedance at the frequency F. However, a network as depicted in FIG. 6 may be more suitable because it is easier for practical implementation.

Also, it may be noted that, in addition to providing excellent isolation, the A/B switch 10 also minimizes the current necessary to force the particular diodes into the "ON" state. As may be observed from FIG. 1, there is just one common current for all of the "ON" diodes in both the A and B sides of the circuit, resulting in a power savings that is important to certain equipment such as portable equipment.

Certain modifications of the present invention have been discussed above. Other modifications will occur to those practicing in the art of the present invention. For example, the A/B switch of the invention may be arranged to provide additional isolation by cascading the diode and impedance networks on both the A and B sides.

Figure 5:
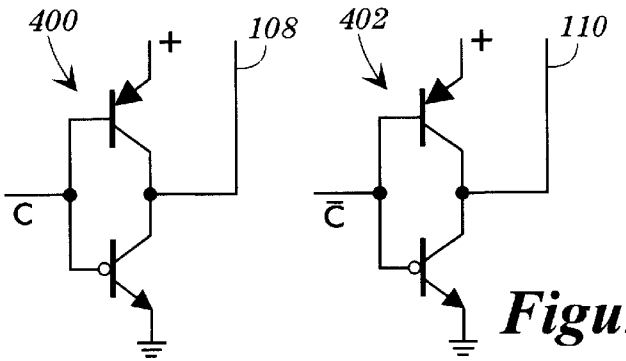
FIG. 5 illustrates an exemplary embodiment of the controller shown in FIG. 1; and, FIG. 6 illustrates an alternative compensation circuit that may be used with the A/B switch of the present invention.

In a further example, an exemplary embodiment of the A/B switch 10 has the A/B switch 10 placed within a receiver. Indeed, the A/B switch 10 may be used within the tuner of a receiver. In this case, the controller 105 can be incorporated as part of the PLL integrated circuit typically found in tuners. An exemplary set of such transistors is illustrated in FIG. 5, where one transistor pair of first and second transistor pairs 400 and 402 receives a control signal and the other transistor pair of the first and second transistor pairs 400 and 402 receives an inverted version of the control signal.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

I claim:

1. An RF A/B switch associated with a receiver comprising:

a first input;

a second input;

an output;

a first diode circuit comprising a plurality of diodes and an impedance network coupled between the first input and the output;

a second diode circuit comprising a plurality of diodes and an impedance network coupled between the second input and the output; and, a controller, wherein the controller is arranged to establish a common series biasing current through at least one of the diodes in each of the first and second diode circuits, wherein the common series biasing current biases one of the first and second diode circuits so as to configure a respective one of the impedance networks in a low pass filter configuration that couples a signal on one of the first and second inputs to the output, and wherein the common series biasing current biases the other of the first and second diode circuits in a blocking configuration so as to block a signal on the other of the first and second inputs from the output.

2. The RF A/B switch of claim 1 wherein the plurality of diodes of the first diode circuit comprises at least a first diode coupled between the first input and the output and a second diode coupled to a reference potential so that the first diode is forward biased and the second diode is reversed biased by the common series biasing current when the signal on the first input is to be coupled to the output and so that the first diode is reversed biased and the second diode is forward biased by the common series biasing current when the signal on the second input is to be coupled to the output.

3. The RF A/B switch of claim 2 wherein the first diode circuit in its blocking configuration includes an equivalent series impedance, wherein the RF A/B switch further comprises a compensation impedance, wherein the compensation impedance is coupled to the first diode circuit, and wherein the compensation impedance is arranged to substantially cancel the equivalent series impedance at a predetermined frequency.

4. The RF A/B switch of claim 2 wherein the plurality of diodes of the second diode circuit comprises at least a third diode coupled between the second input and the output and a fourth diode coupled to a reference potential so that the third diode is forward biased and the fourth diode is reversed biased by the common series biasing current when the signal on the second input is to be coupled to the output and so that the third diode is reversed biased and the fourth diode is forward biased by the common series biasing current when the signal on the first input is to be coupled to the output.

5. The RF A/B switch of claim 4 wherein the first diode circuit in its blocking configuration includes a first equivalent series impedance, wherein the second diode circuit in its blocking configuration includes a second equivalent series impedance, wherein the RF A/B switch further comprises first and second compensation impedances, wherein the first compensation impedance is coupled to the first diode circuit, wherein the first compensation impedance is arranged to substantially cancel the first equivalent series impedance at a first predetermined frequency, wherein the second compensation impedance is coupled to the third diode circuit, and wherein the second compensation impedance is arranged to substantially cancel the second equivalent series impedance at a second predetermined frequency.

6. The RF A/B switch of claim 1 wherein the plurality of diodes of the first diode circuit comprises first, second, third, and fourth diodes, wherein the first and second diodes are coupled between the first input and the output, wherein the third and fourth diodes are coupled to a reference potential, wherein the common series biasing current forward biases the first and second diodes and reverse biases the third and fourth diodes when the signal on the first input is to be coupled to the output, and wherein the common series biasing current reverse biases the first and second diodes and forward biases the third and fourth diodes when the signal on the second input is to be coupled to the output.

7. The RF A/B switch of claim 6 wherein the first diode circuit in its blocking configuration includes an equivalent series impedance, wherein the RF A/B switch further comprises a compensation impedance, wherein the compensation impedance is coupled to the first diode circuit, and wherein the compensation impedance is arranged to substantially cancel the equivalent series impedance at a predetermined frequency.

8. The RF A/B switch of claim 6 wherein the plurality of diodes of the second diode circuit comprises fifth, sixth, seventh, and eighth diodes, wherein the fifth and sixth diodes are coupled between the second input and the output, wherein the seventh and eighth diodes are coupled to a reference potential, wherein the common series biasing current forward biases the fifth and sixth diodes and reverse biases the seventh and eighth diodes when the signal on the second input is to be coupled to the output, and wherein the common series biasing current reverse biases the fifth and sixth diodes and forward biases the seventh and eighth diodes when the signal on the first input is to be coupled to the output.

9. The RF A/B switch of claim 8 wherein the first diode circuit in its blocking configuration includes a first equivalent series impedance, wherein the second diode circuit in its blocking configuration includes a second equivalent series impedance, wherein the RF A/B switch further comprises first and second compensation impedances, wherein the first compensation impedance is coupled to the first diode circuit, wherein the first compensation impedance is arranged to substantially cancel the first equivalent series impedance at a first predetermined frequency, wherein the second compensation impedance is coupled to the second diode circuit, and wherein the second compensation impedance is arranged to substantially cancel the second equivalent series impedance at a second predetermined frequency.

10. The RF A/B switch of claim 1 wherein the first diode circuit in its blocking configuration includes a first equivalent series impedance, wherein the second diode circuit in its blocking configuration includes a second equivalent series impedance, and wherein the RF A/B switch further comprises a first compensation impedance arranged to substantially cancel the first equivalent series impedance at a first predetermined frequency and a second compensation impedance arranged to substantially cancel the second equivalent series impedance at a second predetermined frequency.

11. The RF A/B switch of claim 1 wherein the impedance network of the first diode circuit comprises an inductor having an impedance value selected to allow the impedance network of the first circuit to effectively operate in the low pass filter configuration when the signal on the first input is coupled to the output and to effectively block the signal on the first input when the signal on the second input is coupled to the output, and wherein the impedance network of the second diode circuit comprises an inductor having an impedance value selected to allow the impedance network of the second circuit to effectively operate in the low pass filter configuration when the signal on the second input is coupled to the output and to effectively block the signal on the second input when the signal on the first input is coupled to the output.

12. An RF A/B switch associated with a receiver comprising:

a first input;

a second input;

an output;

a first circuit coupling the first input to the output, wherein the first circuit includes a first diode and a first impedance, and wherein the first diode is coupled between the first input and the output;

a second circuit coupling the second input to the output, wherein the second circuit includes a second diode and a second impedance, and wherein the second diode is coupled between the second input and the output;

a third diode coupling the first circuit to a reference;

a fourth diode coupling the second circuit to a reference; and, a controller, wherein the controller is arranged to establish a biasing current common to both of the first and second circuits, wherein the biasing current forward biases the first and fourth diodes and reverse biases the second and third diodes so as to configure the first impedance as a low pass filter between the first input and the output and so as to configure the second circuit in a signal blocking state when a signal on the first input is to be coupled to the output, and wherein the biasing current reverse biases the first and fourth diodes and forward biases the second and third diodes so as to configure the second impedance as a low pass filter between the second input and the output and so as to configure the first circuit in a signal blocking state when a signal on the second input is to be coupled to the output.

13. The RF A/B switch of claim 12 wherein the first circuit in its signal blocking state includes a first equivalent series impedance, wherein the RF A/B switch further comprises a compensation impedance, wherein the compensation impedance is coupled to the first circuit, and wherein the compensation impedance is arranged to substantially cancel the first equivalent series impedance at a first predetermined frequency.

14. The RF A/B switch of claim 12 wherein the first circuit in its signal blocking state includes a first equivalent series impedance, wherein the second circuit in its signal blocking state includes a second equivalent series impedance, wherein the RF A/B switch further comprises first and second compensation impedances, wherein the first compensation impedance is coupled to the first circuit, wherein the second compensation impedance is coupled to the second circuit, wherein the first compensation impedance is arranged to substantially cancel the first equivalent series impedance at a first predetermined frequency, and wherein the second compensation impedance is arranged to substantially cancel the second equivalent series impedance at a second predetermined frequency.

15. The RF A/B switch of claim 14 wherein the first and second predetermined frequencies are substantially equal.

16. The RF A/B switch of claim 12 wherein the first circuit is identical to the second circuit.

17. An RF A/B switch associated with a receiver comprising:

a first input;

a second input;

an output;

a first diode circuit comprising a plurality of diodes and an impedance network coupled between the first input and the output;

a second diode circuit comprising a plurality of diodes and an impedance network coupled between the second input and the output;

a controller, wherein the controller is arranged to establish a common series biasing current through at least one of the diodes in each of the first and second diode circuits, wherein the common series biasing current biases one of the first and second diode circuits so as to configure a respective one of the impedance networks in a low pass filter configuration that couples a signal on one of the first and second inputs to the output, wherein the common series biasing current biases the other of the first and second diode circuits in a blocking configuration so as to block a signal on the other of the first and second inputs from the output, and wherein the other of the first and second diode circuits in the blocking configuration has an equivalent series impedance; and, a compensation impedance arranged to substantially cancel the equivalent series impedance at a predetermined frequency.

18. The RF A/B switch of claim 17 wherein the plurality of diodes of the first diode circuit comprises at least a first diode coupled between the first input and the output and a second diode coupled to a reference potential so that the first diode is forward biased and the second diode is reversed biased by the common series biasing current when the signal on the first input is to be coupled to the output and so that the first diode is reversed biased and the second diode is forward biased by the common series biasing current when the signal on the second input is to be coupled to the output.

19. The RF A/B switch of claim 18 wherein the plurality of diodes of the second diode circuit comprises at least a third diode coupled between the second input and the output and a fourth diode coupled to a reference potential so that the third diode is forward biased and the fourth diode is reversed biased by the common series biasing current when the signal on the second input is to be coupled to the output and so that the third diode is reversed biased and the fourth diode is forward biased by the common series biasing current when the signal on the first input is to be coupled to the output.

20. The RF A/B switch of claim 17 wherein the plurality of diodes of the first diode circuit comprises first, second, third, and fourth diodes, wherein the first and second diodes are coupled between the first input and the output, wherein the third and fourth diodes are coupled to a reference potential, wherein the common series biasing current forward biases the first and second diodes and reverse biases the third and fourth diodes when the signal on the first input is to be coupled to the output, and wherein the common series biasing current reverse biases the first and second diodes and forward biases the third and fourth diodes when the signal on the second input is to be coupled to the output.

21. The RF A/B switch of claim 20 wherein the plurality of diodes of the second diode circuit comprises fifth, sixth, seventh, and eighth diodes, wherein the fifth and sixth diodes are coupled between the second input and the output, wherein the seventh and eighth diodes are coupled to a reference potential, wherein the common series biasing current forward biases the fifth and sixth diodes and reverse biases the seventh and eighth diodes when the signal on the second input is to be coupled to the output, and wherein the common series biasing current reverse biases the fifth and sixth diodes and forward biases the seventh and eighth diodes when the signal on the first input is to be coupled to the output.

22. The RF A/B switch of claim 17 wherein, when the signal on the first input is to be coupled to the output, the common series biasing current biases the first diode circuit so as to configure the impedance network corresponding to the first diode circuit in a low pass filter configuration that couples the signal on the first input to the output and the common series biasing current biases the second diode circuit in a blocking configuration so as to block the signal on the second input from the output, wherein, when the signal on the second input is to be coupled to the output, the common series biasing current biases the second diode circuit so as to configure the impedance network corresponding to the second diode circuit in a low pass filter configuration that couples the signal on the second input to the output and the common series biasing current biases the first diode circuit in a blocking configuration so as to block the signal on the first input from the output, wherein the equivalent series impedance is a first equivalent series impedance, wherein the first diode circuit includes the first equivalent series impedance when the first diode circuit is in the blocking configuration, wherein the compensation impedance is a first compensation impedance, wherein the first compensation impedance is arranged to substantially cancel the first equivalent series impedance at a first predetermined frequency, wherein the RF A/B switch further comprises a second compensation impedance, wherein the second diode circuit includes a second equivalent series impedance when the second diode circuit is in the blocking configuration, and wherein the second compensation impedance is arranged to substantially cancel the second equivalent series impedance at a second predetermined frequency.

23. The RF A/B switch of claim 22 wherein the impedance network of the first diode circuit comprises an inductor having an impedance value selected to allow the impedance network of the first circuit to effectively operate in the low pass filter configuration when the signal on the first input is to be coupled to the output and to effectively block the signal on the first input when the signal on the second input is to be coupled to the output, and wherein the impedance network of the second diode circuit comprises an inductor having an impedance value selected to allow the impedance network of the second circuit to effectively operate in the low pass filter configuration when the signal on the second input is to be coupled to the output and to effectively block the signal on the second input when the signal on the first input is to be coupled to the output.

24. The RF A/B switch of claim 22 wherein the first and second predetermined frequencies are substantially equal.

25. The RF A/B switch of claim 17 wherein the impedance network of the first diode circuit comprises an inductor having an impedance value selected to allow the impedance network of the first circuit to effectively operate in the low pass filter configuration when the signal on the first input is to be coupled to the output and to effectively block the signal on the first input when the signal on the second input is to be coupled to the output, and wherein the impedance network of the second diode circuit comprises an inductor having an impedance value selected to allow the impedance network of the second circuit to effectively operate in the low pass filter configuration when the signal on the second input is to be coupled to the output and to effectively block the signal on the second input when the signal on the first input is to be coupled to the output.

26. The RF A/B switch of claim 17 wherein the impedance network of the first diode circuit comprises a first inductor, and wherein the impedance network of the second diode circuit comprises a second inductor.

27. The RF A/B switch of claim 17 wherein the compensation impedance comprises a resistive/capacitive circuit.

28. The RF A/B switch of claim 17 wherein the first and second diode circuits comprises substantially identical components.

* * * * *